US012416473B2

(12) United States Patent
Seigler

(10) Patent No.: US 12,416,473 B2
(45) **Date of Patent: *Sep. 16, 2025**

(54) DRY FIRE PRACTICE TRAINING DEVICE

(71) Applicant: Sarah R. Seigler, Kamiah, ID (US)

(72) Inventor: Stanley H. Seigler, Kamiah, ID (US)

( * ) Notice: Subject to any disclaimer, the term of this patent is extended or adjusted under 35 U.S.C. 154(b) by 95 days.

This patent is subject to a terminal disclaimer.

(21) Appl. No.: 18/473,466

(22) Filed: Sep. 25, 2023

(65) Prior Publication Data

US 2024/0011741 A1 Jan. 11, 2024

Related U.S. Application Data

(63) Continuation of application No. 17/945,657, filed on Sep. 15, 2022, now Pat. No. 11,796,287, which is a continuation of application No. 16/425,832, filed on May 29, 2019, now Pat. No. 11,460,271.

(51) Int. Cl.
*F41G 3/26* (2006.01)

(52) U.S. Cl.
CPC ..... *F41G 3/2616* (2013.01)

(58) Field of Classification Search
CPC ..... F41G 3/2616
USPC ..... 434/21
See application file for complete search history.

(56) References Cited

U.S. PATENT DOCUMENTS

| | | | | |
|---|---|---|---|---|
| 4,725,235 | A | 2/1988 | Schroeder | |
| 5,577,962 | A | 11/1996 | Kounoe | |
| 8,770,978 | B2 | 7/2014 | Botten | |
| 8,777,620 | B1 | 7/2014 | Baxter | |
| 9,163,904 | B2 | 10/2015 | Ohr | |
| 9,182,189 | B2 | 11/2015 | Seigler | |
| 11,796,287 | B2 * | 10/2023 | Seigler | F41A 33/00 |
| 2011/0047847 | A1 | 3/2011 | Hughes | |
| 2011/0306020 | A1 | 12/2011 | Peterson | |
| 2013/0108991 | A1 | 5/2013 | Walls | |
| 2014/0193778 | A1 | 7/2014 | Seigler | |
| 2017/0146310 | A1 | 5/2017 | Biran | |
| 2017/0268845 | A1 | 9/2017 | Jakob | |
| 2019/0025000 | A1 | 1/2019 | Bascom | |

FOREIGN PATENT DOCUMENTS

| | | |
|---|---|---|
| KR | 20070010263 | 1/2007 |
| WO | 2008069560 | 6/2008 |

OTHER PUBLICATIONS

International Search Report and Written Opinion dated: Feb. 3, 2020 in International Patent Application No. PCT/US2019/058266 filed: Oct. 28, 2019.

* cited by examiner

*Primary Examiner* — Robert P Bullington
(74) *Attorney, Agent, or Firm* — Randall Danskin P.S.

(57) ABSTRACT

When a semi-automatic weapon is live fired, it's firing pin is reset, and it is ready to be fired again. The shooter's hands remain in the firing position, and just the trigger finger and trigger are employed. With dry fire practice, the shooter must manually rack the slide to reset the firing pin, allowing the trigger to return to its unfired position each time a shot is simulated. This invention provides, realistic muscle memory training by duplicating the action of the trigger in normal live fire, the feel and the sound of the release of the firing pin, and the resetting of the trigger for additional trigger activation. The invention further provides components that allow use with other electronic training devices such as lasers, video simulators, and virtual reality.

11 Claims, 4 Drawing Sheets

DRY FIRE PRACTICE TRAINING DEVICE

CROSS-REFERENCE TO RELATED APPLICATIONS

This application is a Continuation Application of, and claims priority pursuant to 35 USC § 120, to US co-pending U.S. Utility patent application Ser. No. 17/945,657 that was filed on Sep. 15, 2022 entitled "DRY FIRE PRACTICE TRAINING DEVICE," which claims priority to U.S. Utility patent application Ser. No. 16/425,832 that was filed on May 29, 2019 entitled "DRY FIRE PRACTICE TRAINING DEVICE" and which has issued as U.S. Pat. No. 11,460,271. The entire contents and disclosure of earlier-filed, priority applications, U.S. patent application Ser. Nos. 16/425,832 and 17/945,657 are fully incorporated herein by this reference. Inventorship of this continuation application is the same as that of aforementioned U.S. patent application Ser. Nos. 16/425,832 and 17/945,657.

TECHNICAL FIELD

This invention relates to firearms, and more particularly to a dry fire training device.

BACKGROUND OF THE INVENTION

Live firing is the best way to practice drawing and firing a weapon. The practice process builds muscle memory, and helps the shooter develop proper techniques of delivery and complete weapon control. There are several negatives of this type of practice. Using ammunition is an ongoing expense, and measures have to be taken to practice with safety. This could mean traveling to a firing range, providing safety equipment for the shooter and possibly others, and allotting special time in the schedule for the practice session.

Dry fire practice is a good substitute for live fire practice. Dry firing is another process of building muscle memory whereby a firearm, especially a pistol, is drawn, aimed, and fired without using live ammunition. This enables the practice of firing a weapon to proceed smoothly and accurately without all of the negatives of live fire practice. Because no live ammunition is used, there is no ongoing expense, there is no need to use safety equipment, a special shooting environment is not necessary, and practicing can be accomplished in much less time.

Dry firing also allows the shooter to practice in the actual environment where the weapon may need to be used for protection such as in the home. With complete safety, actual shooting scenarios can be practiced in and around the home.

Practicing at the range can also be improved. When live fire is practiced at the range, the novice shooter usually has to spend a significant amount of time and expend a lot of ammunition getting accustomed to the report and recoil of the pistol. Before live practice begins, some dry fire practicing can be done. This gets the novice shooter accustomed to the trigger feel before having to deal with the recoil and the report of live firing.

A major negative factor occurs with most methods of dry firing because when a semi-automatic pistol is live fired, it resets its firing pin and is the pistol ready to be fired again until the magazine is empty. The shooter's hands remain in the firing position, and just the trigger finger and the trigger are employed. With normal dry fire practice, after the first activation of the trigger releasing the firing pin, the shooter must remove a hand from the pistol, and rack the slide back in order to reset the firing pin. The shooter can then let the trigger return to its unfired position. The pistol is then ready for another activation. This must be done each time a shot is simulated. Doing this teaches improper muscle memory because it is not at all what happens during actual live fire. When people are in real shooting situations, they need to be able to depend on simply acting upon how they have practiced. Anything else could be deadly.

Another negative for standard dry fire practice is there is concern as to wear and tear on the constant releasing of a weapon's firing pin without it having the cushioning effect of the firing pin striking a round of ammunition.

Some patent training systems incorporate computer graphics into the training scenario. Other patents address the duplication of a pistol's recoil, laser marking of "shots", projecting images onto a screen, etc.

Here are a few examples of pistol training patents:

U.S. PATENT DOCUMENTS

U.S. Pat. No. 5,993,215; Nov. 30, 1999 Jansen; Kotsiopoulos.

U.S. Pat. No. 4,657,511 Apr. 14, 1987 Allard; Briard; Saunier

U.S. Pat. No. 4,725,235 Feb. 16, 1988 Schroeder; Osborne

U.S. Pat. No. 4,737,106 Apr. 12, 1988; Laciny

U.S. Pat. No. 4,804,325 Feb. 14, 1989 Willits; Kleeman; Willits

U.S. Pat. No. 5,451,162 Sep. 19, 1995 Parsons

U.S. Pat. No. 9,182,189 Nov. 10, 2015 Seigler

These are some devices or systems that aid in dry fire practice, but only one of the patented devices (U.S. Pat. No. 9,182,189) or systems address the "hands-free" trigger reset problem or the firing pin use problem.

Negative qualities of these devices or systems are that they are either user intensive and/or expensive to purchase, but most significantly they do not allow a shooter to use a fully functioning pistol that he may already own. There is also a learning curve or training necessary to use these systems, but most of all, none of the patented devices or systems except (U.S. Pat. No. 9,182,189) address the "hands-free" trigger reset problem and the possible firing pin damage problem of normal dry fire practice.

The device with U.S. Pat. No. 9,182,189 (my previous patent) solves all of the stated problems, but there are improvements that need to be made. The means for insertion into the magazine's well has been simplified, internal parts have been improved, and alterations have been provided so that the device can interact with electronic training systems through a micro switch and electronic components.

There is no device that provides proper dryfire training as already described that also has components that will allow it to interact with electronic training devices like lasers, simulators, and virtual reality.

There is therefore a need for a dry fire training device that uses a fully functioning pistol, allows for precise muscle memory training, is simple to operate, prevents the firing pin of the fully functioning pistol from being damaged, provides for safe on-site home training, inserts easily into the magazine well, and has capabilities to interact with electronic training systems. This new device improves upon existing device U.S. Pat. No. 9,182,189 (my previous patent).

BRIEF SUMMARY OF THE INVENTION

The invention that is to be described accomplishes the most important aspects of dry fire training: no live ammunition is used providing safety and no on-going expense, convenience of practicing in the home environment where the protective, fully functioning pistol would most likely be used for defensive purposes, no involved disassembling and reassembling of any of the fully functional pistol's components, the realistic feel of the trigger during the firing process and the trigger reset, precise muscle memory training using only the trigger finger motion, and does not negatively affect the fully functional pistol's firing pin. This invention also helps the novice shooter train with his pistol before he has to deal with the recoil and the report of firing live ammunition. This invention is simple to use, provides realistic feel of the trigger operation, produces a sound that simulates the release of the pistol's firing pin, and does not require any alterations to the fully functional pistol such as disassembling and reassembling of any parts of the pistol. There is therefore a need for a dry fire training device that uses a fully functioning pistol, allows for precise muscle memory training, is simple to operate, prevents the firing pin of the fully functioning pistol from being damaged, provides for safe on-site home training, inserts easily into the magazine well, and has capabilities to interact with electronic training systems. This new device improves upon existing device U.S. Pat. No. 9,182,189 (my previous patent). This improved device addresses these situations through the pistol's magazine compartment. This invention simply slides into the magazine compartment in the pistol's handle, and practice can begin. It requires no alterations to the pistol before or after practice. This new device functions completely independent of the pistol's firing pin.

An additional point of safety is that the base plate, which is always visible to the shooter and trainer, is a bright color, such as orange or florescent green or pink, to identify the device as being safe and quickly and easily visibly distinguishable from a magazine that could contain live ammunition. There is no way that this device can mechanically accommodate any live ammunition.

DETAILED DESCRIPTION OF THE INVENTION

Figure 1:
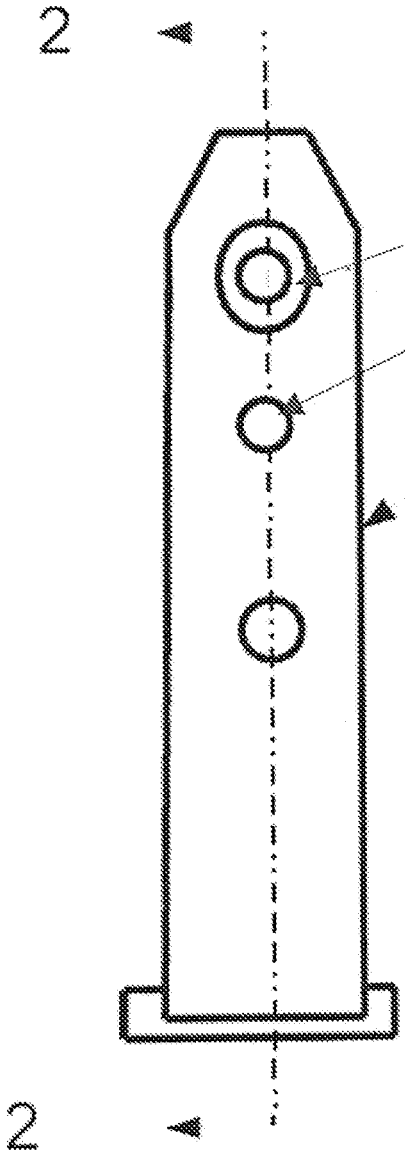
FIG. 1 illustrates a back view of a simulated magazine case with an adjusting set screw base adhered to or at least partially captured or enveloped within its inner back wall.
Figure 2:
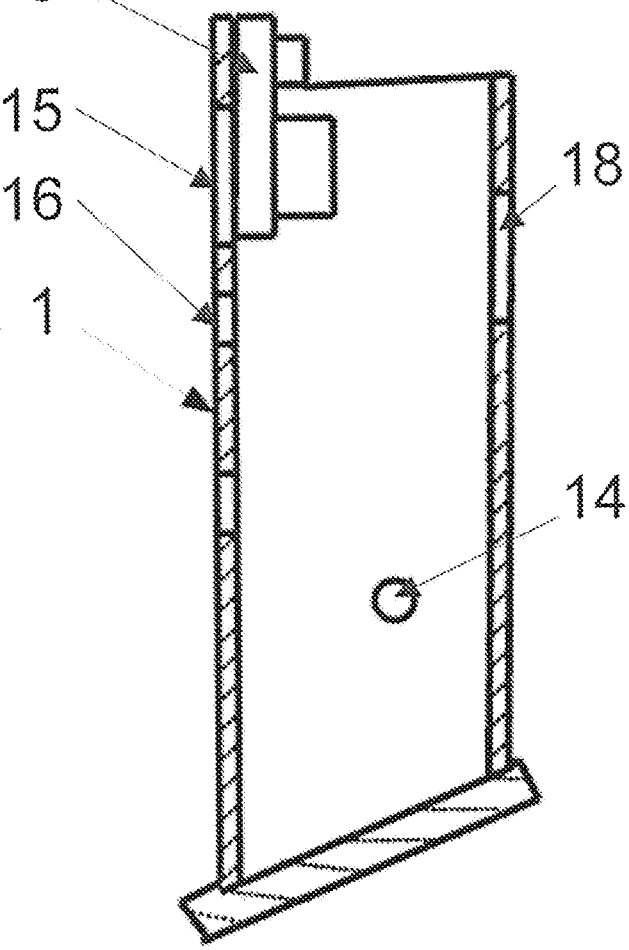
FIG. 2 illustrates a sectional side view of said simulated magazine case showing the set screw base adhered to or at least partially captured or enveloped within its back wall.

FIG. 1 illustrates a back view of the exterior of a simulated magazine case 1. FIG. 2 illustrates a sectional side view of the simulated magazine case 1 along the sectional line 2-2 shown in FIG. 1. FIGS. 1 & 2 illustrate the simulated magazine case 1 that has six holes. The simulated magazine case 1 includes a pair of opposing holes, one in each side of the simulated magazine case 1 (indicated as 14 in FIG. 2). In combination, this pair of opposing holes 14, one in each side of the simulated magazine case 1, are sized and shaped to receive the fulcrum pin 7 (shown in FIG. 19) for the lever 2 (shown in FIG. 19) to hinge upon. The simulated magazine case 1 also includes a third hole (indicated as 15 in FIGS. 1 & 2) in the front of said magazine case 1 to provide access to the regulating set screw 10 (shown in FIG. 19) which is mounted in the set base 5 as illustrated in FIG. 2, being adhered to the inside back wall of said magazine case 1. The simulated magazine case 1 also includes a fourth hole (indicated as 16 in FIGS. 1 & 2) beneath the previously mentioned third hole 15, and which the fourth hole 16 allows for adjusting the mounting screw (indicated as 17 in FIG. 19) for the detent reed 6. The simulated magazine case 1 also includes a fifth hole (not shown) in the back of the magazine 1 for adjusting a second set screw (not shown) in the micro switch lever (indicated as 4 in FIG. 19), the second set screw (not shown) being configured to regulate the adjusting point of another training device. The simulated magazine case 1 also includes a sixth hole (indicated as 18 in FIGS. 2 & 19) in the front of the magazine 1 to allow the swing lock (indicated as 3 in FIG. 19) to interact with a member in the pistol's magazine well (not shown) to lift and place the lever (indicated as 2 in FIG. 19) in the proper position with the pistol's trigger mechanism when the device is inserted into the pistol's magazine well.

Figure 3:
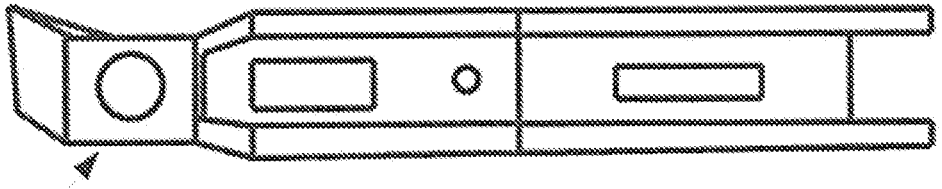
FIG. 3 illustrates a top view of a lever.
Figure 4:
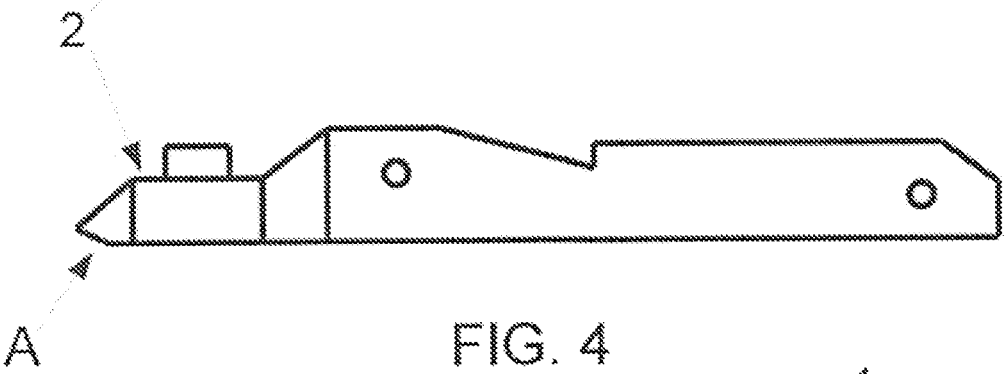
FIG. 4 illustrates a side view of said lever.
Figure 19:
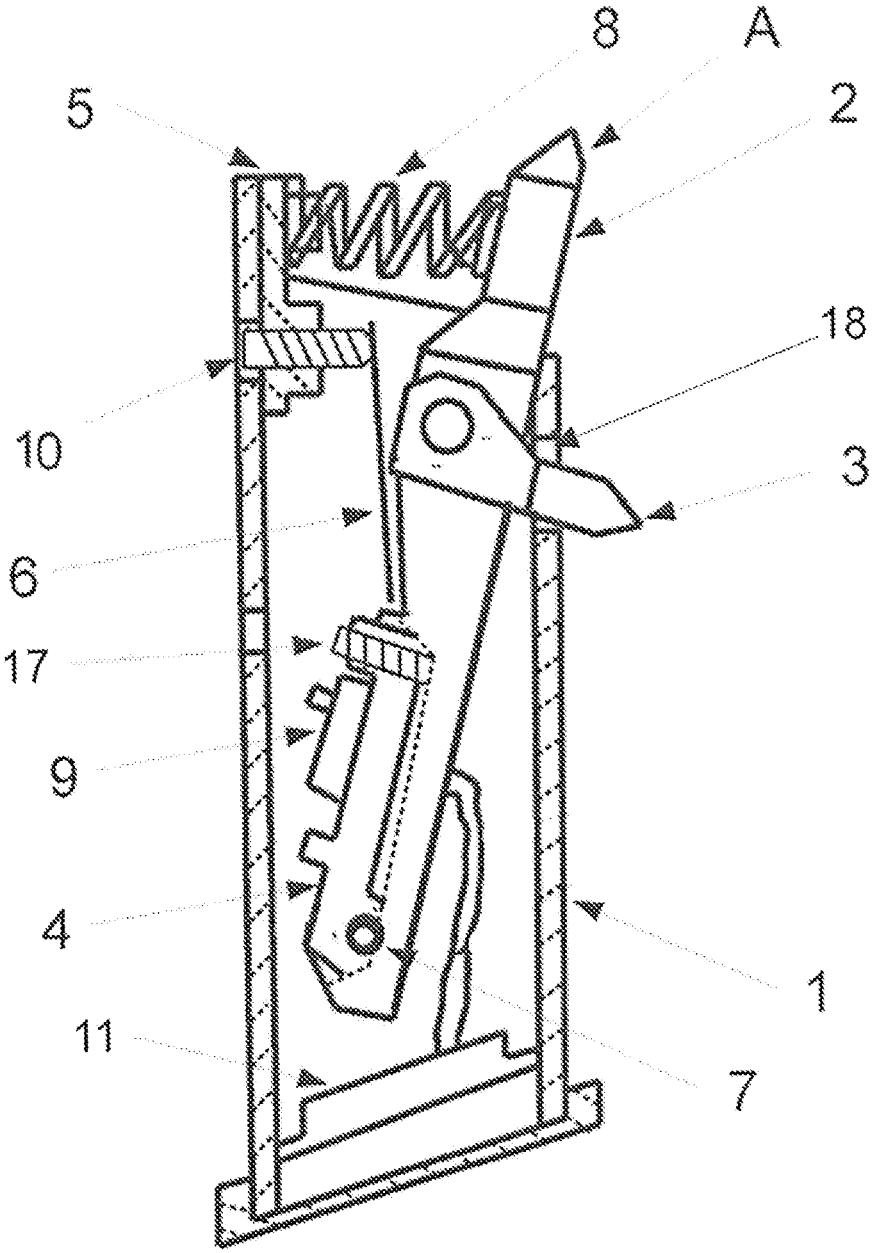
FIG. 19. illustrates a sectional view of the assembled device in its resting position.

FIGS. 3 & 4 illustrate the lever 2 sized and shaped to support the detent reed (indicated as 6 in FIG. 19), locate the compression spring (indicated as 8 in FIG. 19), mount the swing lock (indicated as 3 in FIG. 19), and mount the micro switch lever (indicated as 4 in FIG. 19), and a projection at the top to interact with the pistol's trigger mechanism at point A; all these are illustrated in FIG. 19.

Figure 5:
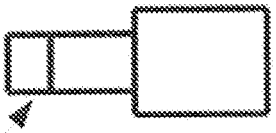
FIG. 5 illustrates a top view of a swing lock.
Figure 6:
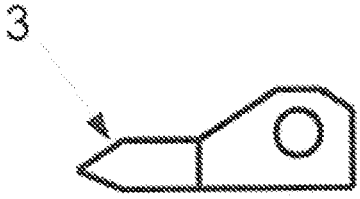
FIG. 6 illustrates a side view of said swing lock.

FIGS. 5 & 6 illustrate the swing lock 3 which is pin mounted to the lever 2 (as shown in FIG. 19) and protrudes out of the hole (indicated as 18 in FIGS. 2 & 19) in the front of the magazine's 1 front side (as shown in FIGS. 2 & 19) to interact with a member in the pistol's magazine well (not shown) which places the lever 2 (as shown in FIG. 19) into its proper position with the pistol's trigger mechanism (not shown). In some embodiments, the swing lock 3 snaps onto a fulcrum pin that is integrated as a molded component of the lever 2.

Figures 7, 8:
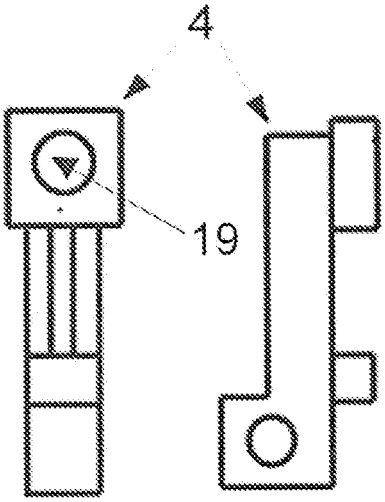
FIG. 7 illustrates a top view of a micro switch lever.
FIG. 8 illustrates a side view of said micro switch lever.

FIGS. 7 & 8 illustrate a micro switch lever 4 which pin mounts to the lever 2 (as shown in FIG. 19), the micro switch lever 4 has a hole for accommodating a second set screw (not shown) for adjustments through the fifth hole (not shown) in the back of the magazine 1, and provides a location for mounting a micro switch 9 (shown in FIG. 19). In some embodiments, the lever 2 includes no microswitch lever 4, but instead the micro switch 9 is mounted to a PC board that is mounted in the case by screws, in such embodiments the lever 2 includes a screw to actuate the micro switch 9.

Figure 9:
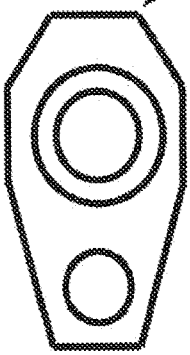
FIG. 9 illustrates a front view of a set screw base.
Figure 10:
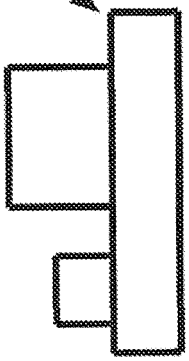
FIG. 10 illustrates a side view of said set screw base.

FIGS. 9 & 10 illustrate the set screw base 5 which is adhered to or at least partially captured or enveloped within the inner back wall of the magazine 1 (as shown in FIGS. 2 & 19) and accommodates the set screw 10 (shown in FIG. 19) to adjust when the detent reed 6 (shown in FIG. 19) snaps as the lever 2 (shown in FIG. 19) is actuated by the pistol's trigger mechanism (not shown) at point A (shown in FIG. 19). In some embodiments, the set screw base 5 includes a protrusion as shown in FIGS. 2, 10, and 19. In some other embodiments (not shown), the case includes a pocket or cavity instead of the protrusion shown in FIGS. 2, 10, and 19.

Figure 11:
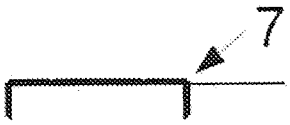
FIG. 11 illustrates a side view of a fulcrum pin.

FIG. 11 illustrates a fulcrum pin 7 that allows the lever 2 (shown in FIG. 19) to rotate to activated the detent reed 6 (shown in FIG. 19) by the action transferred through the lever 2 (shown in FIG. 19) at point A (shown in FIG. 19), moving the detent reed 6 (shown in FIG. 19) against the set screw 10 (shown in FIG. 19), producing the simulated tactile release and the audible response of the weapon's firing pin. Another fulcrum pin (not shown) mounts the micro switch lever 4 (shown in FIG. 19) onto the lever 2 (shown in FIG. 19). In some embodiments, the fulcrum pin 7 and/or another fulcrum pin (not shown) is integrated as a part of lever 2 and/or as a molded portion of one or both case halves.

Figure 12:
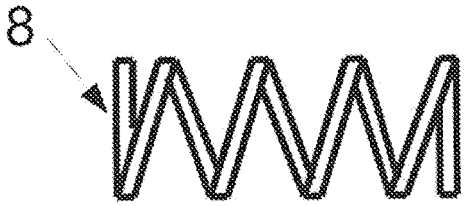
FIG. 12 illustrates a side view of a compression spring.

FIG. 12 illustrates a compression spring 8 that returns the lever 2 (shown in FIG. 19) to its resting position against the front of the magazine 1 (shown in FIG. 19) and resets the pistol's trigger mechanism to its resting position. The location of the compression spring 8 relative to the magazine case 1 and lever 2 is shown at FIG. 19.

Figure 13:
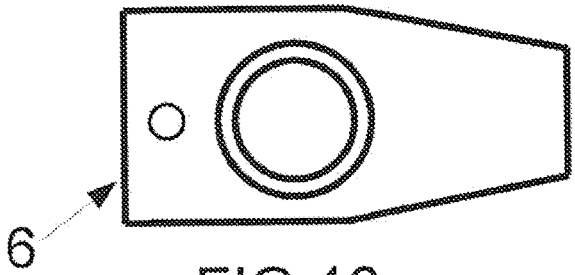
FIG. 13 illustrates a top view of a detent reed.

FIG. 13 illustrates a detent reed 6 which is mounted to the lever 2 (shown at FIG. 19) and provides the tactile release simulating the feel of the release of the pistol's firing pin and an audible response simulating the sound of the release of the pistol's firing pin.

Figure 14:
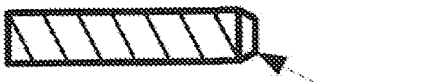
FIG. 14 illustrates a side view of a set screw.

FIG. 14 illustrates the set screw 10 which is used in the set screw base 5 (shown at FIG. 19) and is configured to be adjustable to apply more or less pressure to the detent reed 6 (as shown in FIG. 19). A second set screw (not shown), similar to set screw 10, provides for adjustments to micro switch lever 4 (shown in FIG. 19).

Figure 15:
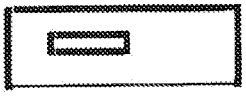
FIG. 15 illustrates a top view of a micro switch.
Figure 16:
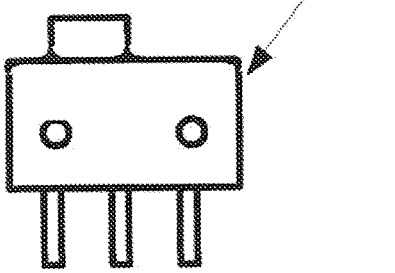
FIG. 16 illustrates a side view of said micro switch.

FIGS. 15 & 16 illustrate the micro switch 9 which is mounted to the micro switch lever 4 (shown in FIG. 19) and presses against the inner wall of the magazine 1 (shown in FIG. 19) to activate an electronic component for other training devices. Persons of ordinary skill in the art will readily recognize that the configuration of the micro switch 9 relative to the inner wall of the magazine 1 is interchangeable, such that the micro switch 9 is mounted to the inner wall of the magazine 1 and in any event the micro switch 9 is depressed when the lever 2 is actuated by the pistol's trigger mechanism.

Figure 17:
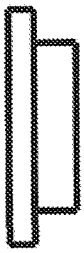
FIG. 17 illustrates a side view of a micro processor.
Figure 18:
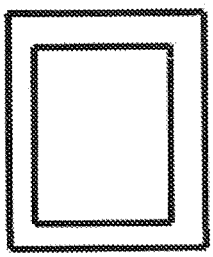
FIG. 18 illustrates a top view of said micro processor

FIGS. 17 & 18 illustrate the micro processor 11 that is activated by the micro switch 9 (shown in FIG. 19) when the lever assembly is hinged towards the back of the magazine 1 (shown in FIG. 19) and thus provides an electrical signal received by another device for dry fire training. In some embodiments, the electrical signal includes a Bluetooth, LED, RF, and/or IR signal.

FIG. 19 illustrates a sectional view of the assembled dry fire training device showing the lever 2 in its resting position. The compression spring 8 is applying a forward force to hold the lever 2 forward. This view shows the detent reed 6 resting against the set screw 10 in its "untripped" or unreleased position. The set screw 10 provides adjustment to control the release of the detent reed 6 at precisely the right position in the travel of the pistol's trigger. The swing lock 3 is mounted to the lever 2 so that when the device is inserted into the pistol's magazine compartment, the swing lock 3 interacts with the pistol's magazine release bar and pushes the lever 2 towards the back of pistol far enough that the lever 2 can freely move behind the pistol's trigger mechanism. The swing lock 3 then swings out of the way so that the lever 2 assembly is free to interact with the pistol's trigger mechanism. When the pistol's trigger mechanism presses against the lever 2 at point A, the lever 2 assembly swings towards the back of the magazine 1. This movement compresses the coil spring 8, bends the detent reed 6 through its activation point against the set screw 10 and provides the tactile and the audible response, thus simulating the release of the pistol's firing pin; the micro switch 9 is compressed against the wall of the magazine 1 completing the circuit to the micro processor 11 which sends a signal to interact with a separate dry fire training device. When the pistol's trigger is released, the coil spring 8 returns the lever 2 assembly to its resting position.

The previously patented device U.S. Pat. No. 9,182,189 had a sliding member that had to be pushed up to accomplish the positioning of the lever 2 behind the trigger mechanism. Then, after the lever 2 was in its working position, the shooter needed to pull the sliding lever lifter back to its resting position. This new design accomplishes this setting action without any additional actions of the shooter. The new devise also has means of interacting electronically with other dry fire training devices.

What is claimed is:

1. A dry fire training device for use with a pistol having an ammunition magazine compartment and a trigger mechanism, the dry fire training device comprising:

a simulated ammunition magazine that has opposing side portions, an exterior surface, and an interior cavity, the simulated ammunition magazine having a platform at a top end portion for operative engagement with a compression spring;

a lever that is pivotably carried within the interior cavity of the simulated ammunition magazine, the lever is elongate and has a bottom end portion that is proximate an inside bottom surface of the interior cavity, and a top end portion that is proximate the top end portion of the simulated ammunition magazine, the lever further having a projection at the top end portion thereof that operatively communicates with the trigger mechanism of the pistol, and a projection for engagement with the compression spring, and the lever is pivotably movable on a fulcrum between a resting position and a firing position, the fulcrum is sandwiched between the opposing side portions inside the interior cavity of the simulated ammunition magazine;

a detent reed carried on the lever, the detent reed formed of a material that generates a tactile and audible signal when manipulated through an activation point between an un-tripped position and a tripped position;

a microswitch operatively connecting the lever to the simulated ammunition magazine such that the microswitch is activated when the lever is pivotably moved on the fulcrum from the resting position to the firing position; and a microprocessor operatively communicating with the microswitch and which sends a signal when the microswitch is activated.

2. The dry fire training device of claim 1 and further comprising:

a laser training device carried by the pistol that receives the signal from the microprocessor and the laser training device is actuated responsive to the signal from the microprocessor.

3. The dry fire training device of claim 1 and further comprising:

a baseplate carried on a bottom end portion exterior surface of the simulated ammunition magazine, and the baseplate is colored so that an observer is able to recognize the pistol ammunition magazine compartment is carrying a simulated ammunition magazine for use with dry fire training.

4. The dry fire training device of claim 1 and further comprising:

a regulating assembly carried inside the interior cavity of the simulated ammunition magazine proximate the top end portion, the regulating assembly having a set screw base carrying a regulating set screw that operatively communicates with the detent reed to provide adjustability to the activation point of the detent reed.

5. The dry fire training device of claim 1 and further comprising:

a swing lock pivotally carried by the lever spaced between the top end portion and the bottom end portion, the swing lock having an end portion that extends through an orifice at a front portion of the simulated ammunition magazine and the extending end portion of the swing lock frictionally communicates with a surface of the pistol ammunition magazine compartment so as to properly position the projection at the top end portion of the lever relative to the pistol trigger mechanism for operation.

6. A method of using a dry fire training device, the method comprising:

providing a dry fire training device for use with a pistol having an ammunition magazine compartment and a trigger mechanism, the dry fire training comprising:

a simulated ammunition magazine that has opposing side portions, an exterior surface, and an interior cavity, the simulated ammunition magazine having a platform at a top end portion for operative engagement with a compression spring;

a lever that is pivotably carried within the interior cavity of the simulated ammunition magazine, the lever is elongate and has a bottom end portion that is proximate an inside bottom surface of the interior cavity, and a top end portion that is proximate the top end portion of the simulated ammunition magazine, the lever further having a projection at the top end portion thereof that operatively communicates with the trigger mechanism of the pistol, and a projection for engagement with the compression spring, and the lever is pivotably movable on a fulcrum between a resting position and a firing position, the fulcrum is sandwiched between the opposing side portions inside the interior cavity of the simulated ammunition magazine;

a detent reed carried on the lever, the detent reed formed of a material that generates a tactile and audible signal when manipulated through an activation point between an un-tripped position and a tripped position;

a microswitch operatively connecting the lever to the simulated ammunition magazine such that the microswitch is activated when the lever is pivotably moved on the fulcrum from the resting position to the firing position; and a microprocessor operatively communicating with the microswitch and which sends a signal when the microswitch is activated;

inserting the dry fire training device into the ammunition magazine compartment of a pistol; and positioning the projection at the top end portion of the lever relative to the pistol trigger mechanism for operation.

7. The method of claim 6, further comprising:

actuating the pistol trigger mechanism to pivotally move the lever from the resting position to the firing position.

8. The method of claim 7, further comprising:

releasing the pistol trigger mechanism to pivotally move the lever from the firing position to the resting position.

9. The method of claim 6, further comprising:

removing the dry fire training device from the ammunition magazine compartment of the pistol.

10. A method of manufacturing a dry fire training device, the method comprising:

providing a first side portion and a second side portion of a simulated ammunition magazine, the first and second side portions opposing one another, and each of the first and second side portions having an exterior surface and an interior cavity, and at least one of the first and second side portions of the simulated ammunition magazine having a platform at a top end portion for operative engagement with a compression spring;

inserting a lever into the interior cavity of one of the first and second side portions of the simulated ammunition magazine, the lever is elongate and has a bottom end portion that is proximate an inside bottom surface of the interior cavity, and a top end portion that is proximate the top end portion of the simulated ammunition magazine, the lever further having a projection at the top end portion thereof that operatively communicates with a trigger mechanism of a pistol, and a projection for engagement with the compression spring, and the lever is pivotably movable on a fulcrum between a resting position and a firing position;

connecting a detent reed to the lever, the detent reed is formed of a material that generates a tactile and audible signal when manipulated through an activation point between an un-tripped position and a tripped position;

operatively connecting the lever to the simulated ammunition magazine with a microswitch such that the microswitch is activated when the lever is pivotably moved on the fulcrum from the resting position to the firing position;

providing a microprocessor to operatively communicate with the microswitch and which sends a signal when the microswitch is activated; and sandwiching the lever and the detent reed between the opposing first and second side portions inside the interior cavity of the simulated ammunition magazine.

11. The method of claim 10 and further comprising:

attaching a baseplate to a bottom end portion exterior surface of the simulated ammunition magazine, and the baseplate is colored so that an observer is able to recognize the pistol ammunition magazine compartment is carrying a simulated ammunition magazine for use with dry fire training.

* * * * *